US005549959A

United States Patent [19]

Compton

[11] Patent Number: 5,549,959

[45] Date of Patent: Aug. 27, 1996

[54] PERFORATED FILM WITH PREPUNCHED TUBE HOLES

[75] Inventor: Stephen F. Compton, Spartanburg, S.C.

[73] Assignee: W. R. Grace & Co.-Conn., Duncan, S.C.

[21] Appl. No.: 262,195

[22] Filed: Jun. 20, 1994

Related U.S. Application Data

[62] Division of Ser. No. 26,898, Mar. 5, 1993, Pat. No. 5,358, 771.

[51] Int. Cl.[6] ..... B32B 9/00

[52] U.S. Cl. ..... 428/131; 206/397; 206/408; 206/410

[58] Field of Search ..... 206/95, 408, 410, 206/397; 428/131

[56] References Cited

U.S. PATENT DOCUMENTS

| | | | |
|---|---|---|---|
| 2,138,216 | 11/1938 | Sunderland | 206/410 |
| 2,764,501 | 9/1956 | Perri | 428/131 |
| 3,405,027 | 10/1968 | Wyckoff | 428/131 |
| 4,135,020 | 1/1979 | Maxwell | 428/131 |
| 4,574,949 | 3/1986 | Rhoads | 206/150 |

*Primary Examiner*—Patrick Ryan
*Assistant Examiner*—Cathy Lee

[57] ABSTRACT

A package comprising a central tube, a product wound around the central tube and a perforated film having tube holes prepunched into the film is disclosed. This perforated prepunched tube hole film allows for substantially all of the product exposed surface to be covered by the perforated film but leaves the central tube ends uncovered.

3 Claims, 3 Drawing Sheets

PERFORATED FILM WITH PREPUNCHED TUBE HOLES

This is a divisional application of application Ser. No. 026,898, filed on Mar. 5, 1993, now U.S. Pat. No. 5,358,771.

BACKGROUND OF THE INVENTION

1. Field of the Invention

The present invention relates to thermoplastic film, and more particularly perforated film having a prepunched tube hole suitable for use in applications such as textile yarn dyeing.

2. Description of the Related Art

In the dyeing of textile yarns, such as cotton, acrylic, wool and blends of various natural and synthetic yarns, a slotted cylindrical plastic or stainless steel tube, known as a dye tube, is typically used to hold a quantity of yarn wound around the tube. This arrangement is known as a yarn package or dye package. These dye packages are processed in a dyeing vat known as a dye kier. A dye of a suitable color typically heated up to about 150° C. and at a pressure of up to about 80 psi, is forced through the yarn in the dyeing process.

This process, because of the high temperature and pressures involved, and the overall environment of the process, can result in some damage to the yarn material, particularly at the outer face of the yarn package.

An effective solution to this problem has been the use of perforated films, of a type such as the PY film sold by the Cryovac Division of W. R. Grace & Co.—Conn., to overwrap the yarn package. If the film is also a shrink film, then a tight fitting but porous overwrap is provided which helps to protect the yarn during the dyeing process, while allowing the dye to flow through the yarn to the outer circumference of the package, and vice versa.

One limitation of conventional perforated film wrapping of the dye package is that the ends of the dye package are not provided with an even tight overwrap up to the tube. This can result in unacceptable dyeing results, especially with rigid, noncompressable, short, low profile dye packages.

OBJECTS AND SUMMARY OF THE INVENTION

One object of the present invention is to provide a film which allows for the substantial flow of a dye or other liquid through the film, and providing the dye package with a substantially uniform film covering while leaving the dye package central tube ends free.

Another object of the present invention is to provide a protective dye package film which covers substantially all of the dye package with the exception of the central tube ends.

Accordingly, one form of the present invention relates to a polymeric film for wrapping dye packages comprising a perforated polymeric film having tube holes therein.

Another form of the present invention relates to a package comprising a product wrapped around a tube, and a polymeric film wrapped around the product, the film characterized by having perforations therein and further having holes to accept the ends of the tube.

A further form of the present invention relates to a yarn package comprising: a central tube, yarn wound around the tube, and a perforated thermoplastic film wrapped around the yarn, wherein the perforated thermoplastic film has holes to receive the central tube ends such that the yarn is covered by the perforated thermoplastic film and the central tube ends are not so covered.

A still further form of the present invention relates to a process for producing a dye package comprising the steps of: winding a product onto a central tube, placing perforated thermoplastic film having tube holes to receive the central tube ends around the product wound on the central tube and the central tube, sealing the longitudinal and transverse edges of the perforated thermoplastic film utilizing a sealing means, thereby sealing the product in said perforated thermoplastic film, and shrinking the perforated thermoplastic film around the product using a shrinking means; characterized in that the perforated thermoplastic film covers substantially all of the exposed product while leaving the central tube ends free.

Preferred forms of the invention, as well as other embodiments, objects, features and advantages of this invention, will be apparent from the following detailed description which is to be read in connection with the accompanying drawings.

DESCRIPTION OF THE PREFERRED EMBODIMENTS OF THE INVENTION

Figure 1:
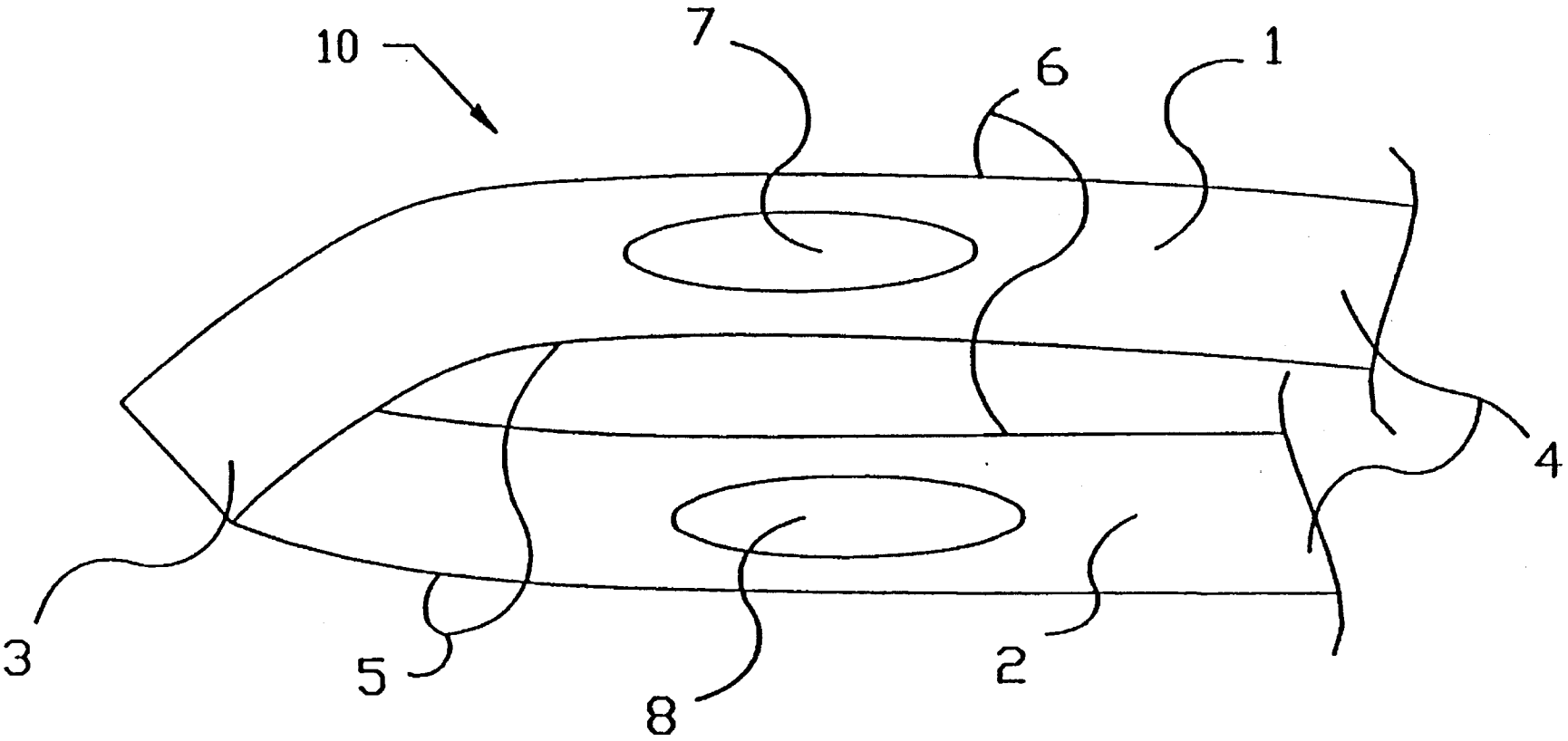
FIG. 1 shows perspective view of the centerfold perforated prepunched tube hole dye package wrapping film of the present invention.

The present invention will be better understood from the specification taken in conjunction with the accompanying drawings in which like reference numerals refer to like parts and the following definitions.

The term "perforation" means: holes of various shapes, density, size and distribution in a thermoplastic film which can be introduced in the film during manufacture of the film or subsequent to production of the film, by various flame, needle, and other suitable processes.

The term "tube hole" means holes generally having shapes to match the shape of the tubes used in dye packages and which allow the film to be wrapped over and around the central tube ends such that the film lies in substantially continuous contact with the yarn of the dye package.

In FIG. 1 there is shown a preferred embodiment of the present invention being composed of a centerfold perforated film 10 having a top layer of film 1 and a bottom layer of films 2 and centerfold 3, and having one longitudinal pair of edges 4 and two sets of transverse pairs of edges 5 and 6, as well as a pair of prepunched tube holes 7 and 8, one tube hole in each of film layers 1 and 2.

Figure 2:
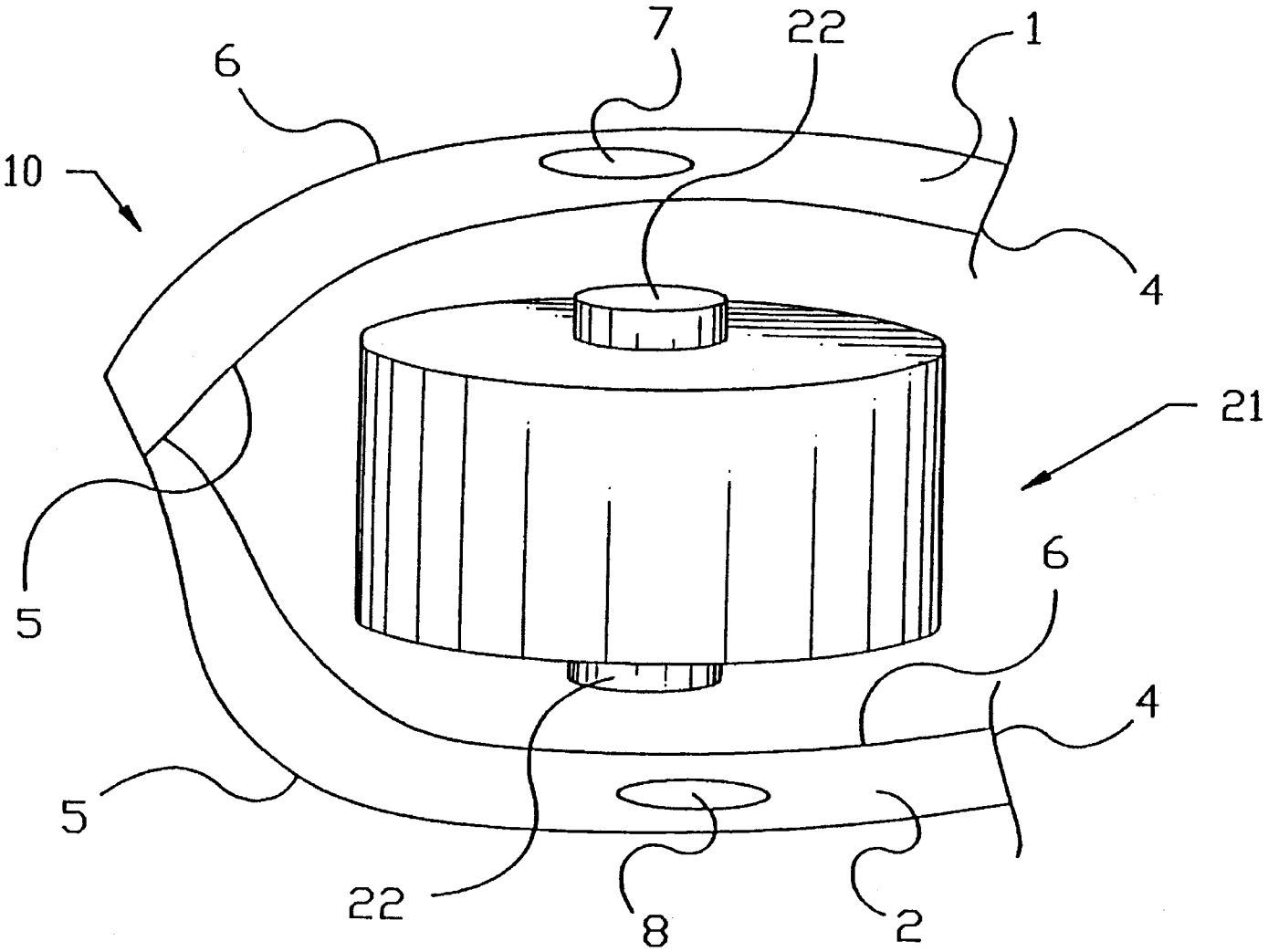
FIG. 2 shows a perspective view of the wrapping film of the present invention as it is placed around a dye package.

FIG. 2 shows a dye package 21 positioned between film layers 1 and 2 having tube holes 7 and 8 located such that central tube ends 22 pass therethrough. Once the dye package is so located the pair of longitudinal edges 4 are sealed together utilizing sealing means well known in the art. Likewise, the transverse edges 5 are sealed together and transverse edges 6 are sealed together using sealing means well known in the art.

Figure 3:
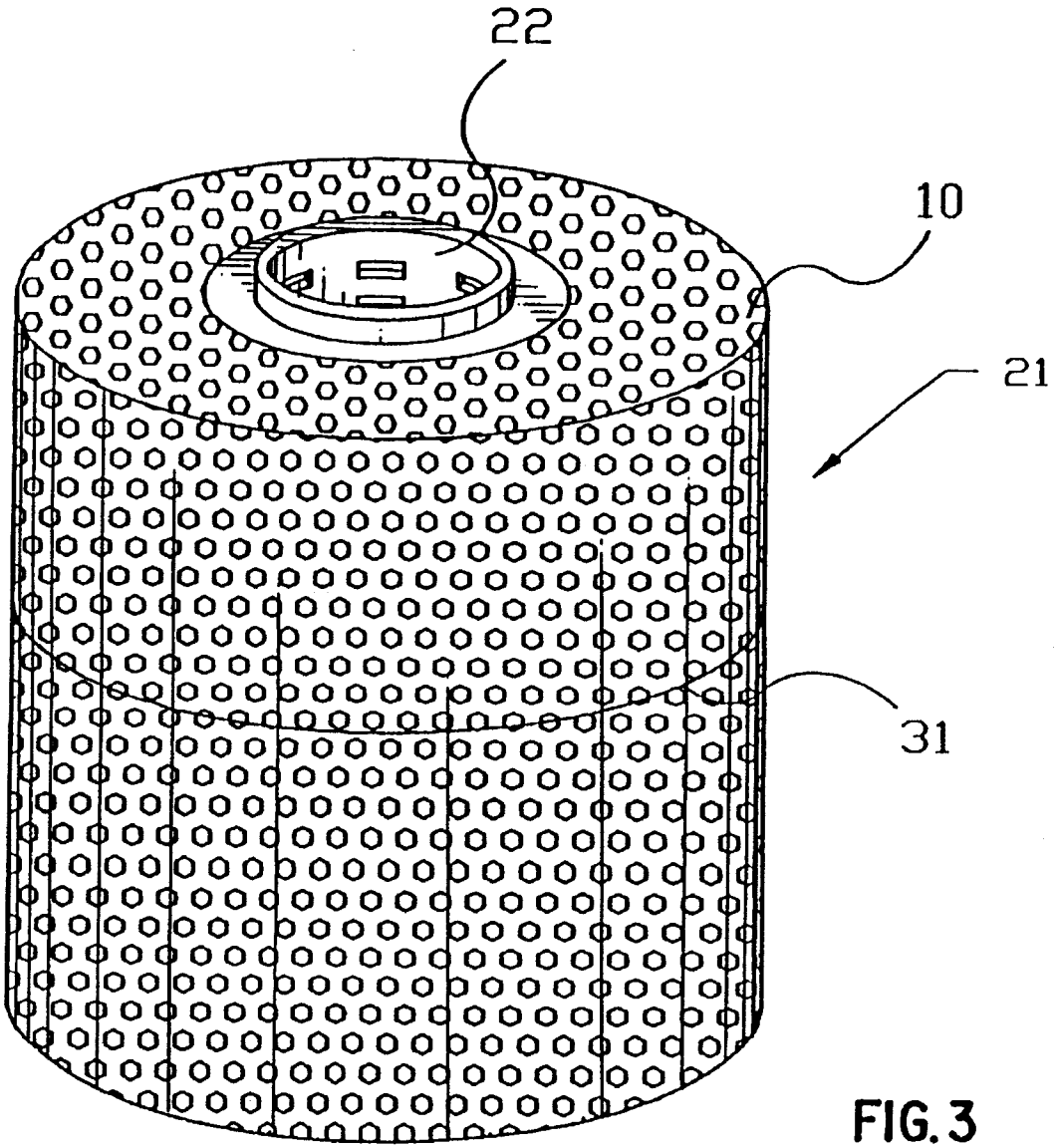
FIG. 3 shows a perspective view of the wrapping film of the present invention after it has been sealed and shrunk around a dye package.

In FIG. 3 is shown a dye package 21 after it has been wrapped with the film of the present invention 10, said film having been sealed and heat shrunk around the dye package. Also shown is seam 31 formed by the sealing of the longitudinal pair of edges 4 and the two pairs of transverse edges 5 and 6. As can be seen central tube ends 22 are free of the film 10 which substantially all of the dye package is covered and protected by said film 10. This substantially complete covering of the dye package helps to provide uniform dyeing of the complete dye package.

While the figures illustrate a preferred embodiment of the present invention it is understood that two separate prepunched sheets 1 and 2 may also be used. In this case there would be two pairs of longitudinal edges and two pairs of transverse edges which are sealed to form the overwrap before the film is shrunk around the dye package to form a tight protective perforated film layer over the dye package.

Suitable film 10 for use in the present invention can be made by conventional processes well known in the art, including extrusion and coextrusion, and extrusion coating and conventional lamination processes for producing mono-layer or multi-layer films. In the case of mono-layer and multi-layer films, various thermoplastic polymers and copolymers can be used, especially materials such as polypropylene or propylene ethylene copolymer, and olefinic polymers and copolymers.

The introduction of perforations in the material can be done in many conventional ways, including flame, needle, and heating/vacuum/blowing operations as long as perforations of suitable density, size, shape and distribution can be imparted to the film.

Perforated films according to the present invention can also be mono-axially or bi-axially oriented, by blown bubble process or tenter frame process well known in the art. A presently preferred perforated film is one commercially available as PY film sold by W. R. Grace & Co.—Conn. through its Cryovac Division. Other perforated films are also commercially available and need no further discussion here.

The introduction of the tube holes into the material can be done in any of several well understood ways, such as for example, hot knife, and die punch. It is to be appreciated that the method of producing the tube holes is not critical and may be accomplished by methods well understood by those skilled in this art. Preferably, the tube holes are sized such that the finished wrapped dye package is substantially completely covered by the film with the exception of the central tube ends themselves. Furthermore, the tube holes may be introduced into the film simultaneously with the introduction of the perforations, before the introduction of the: perforations or after the introduction of the perforations. Also, the tube holes may be produced by the film manufacturer or may be introduced to the perforated film by the dye package operator.

In practice a dye package 21 is placed between layers 1 and 2 of perforated film 10 having prepunched tube holes 7 and 8 and positioned such that central tube ends 22 pass through film layers 1 and 2 at tube holes 7 and 8. The film 10 being of sufficient size such that longitudinal edges 4 and the transverse edges 5 and 6 can be sealed together using a sealing means. The film wrapped dye package is then exposed to a film shrinking means, if the film 10 is a shrinkable film, and said film 10 is shrunk to form a tight fitting substantially complete covering film for dye package 21. The tube holes 7 and 8 allow the central tube ends 22 to remain exposed and not covered by film 10. The resulting perforated film covered dye package responds more uniformly to the known dyeing processes.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. A package comprising:

a) a product wrapped around a tube, and b) a polymeric thermoplastic film wrapped around the product, the film characterized by having perforations therein and further having holes to accept the ends of the tube.

2. The polymeric film as claimed in claim 1 wherein, said film is an oriented film.

3. A yarn package comprising:

(a) a central tube, (b) yarn wound around the tube, and (c) a perforated thermoplastic film wrapped around the yarn, wherein the perforated thermoplastic film has holes to receive the tube ends such that the yarn is covered by the perforated thermoplastic film and the central tube is not so covered.

* * * * *